US005123566A

United States Patent [19]

Lage et al.

[11] Patent Number: 5,123,566

[45] Date of Patent: Jun. 23, 1992

[54] FACIAL TISSUE DISPENSER

[75] Inventors: David P. Lage; Wells Bearinger, both of St. Louis, Mo.

[73] Assignee: Quick Point, Inc., Fenton, Mo.

[21] Appl. No.: 745,228

[22] Filed: Aug. 14, 1991

[51] Int. Cl.[5] ..... B65H 1/00

[52] U.S. Cl. ..... 221/46; 221/61; 221/63

[58] Field of Search ..... 221/33, 45, 46, 47–49, 221/61, 63, 282, 283, 281

[56] References Cited

U.S. PATENT DOCUMENTS 1,734,045 11/1929 Parran ..... 221/282 X
3,164,298 1/1965 Repko ..... 221/282
3,307,740 3/1967 Fant ..... 221/282 X
3,383,012 5/1968 Adell ..... 221/63 X
4,185,753 1/1980 Leto ..... 221/49 X

*Primary Examiner*—David H. Bollinger
*Attorney, Agent, or Firm*—Gravely, Lieder & Woodruff

[57] ABSTRACT

A one-piece facial tissue dispenser having a hinged top and bottom with a releasible clasp opposite the hinge. The top has a transverse slot adjacent to one end and is provided with space for printing, advertizing or other indicia adjacent to the slot. A package of folded facial tissue is positioned within the dispenser with the free ends adjacent to the slot so that the tissues are removable one-by-one through the slot.

8 Claims, 1 Drawing Sheet

FACIAL TISSUE DISPENSER

BACKGROUND OF THE INVENTION

This application relates to facial tissue dispensers and, in particular, relates to the combination of a facial tissue dispenser having a hinged cover with a transverse slot adjacent to one end of the cover and a package of folded facial tissues positioned within the dispenser for withdrawal through the transverse slot.

These and other objects and advantages will become apparent hereinafter.

SUMMARY OF THE INVENTION

The invention comprises a facial tissue dispenser having a slot in the top through which folded facial tissues are individually dispensed.

This invention also consists in the parts and in the arrangements and combinations of parts hereinafter described an claimed.

DESCRIPTION OF THE DRAWINGS

In the accompanying drawings which form part of the specification and wherein like numerals and letters refer to like parts wherever they occur

DETAILED DESCRIPTION

Figure 1:
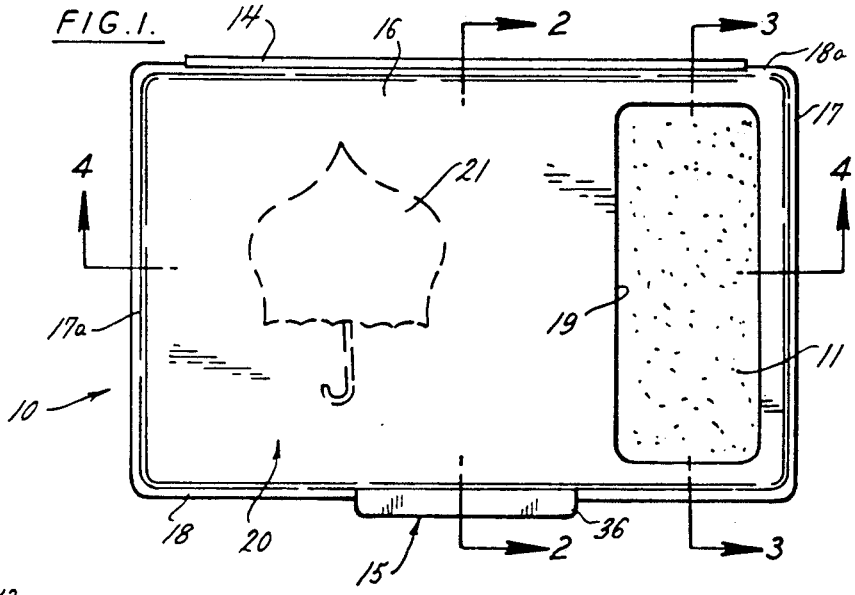
FIG. 1 is a top plan view of the present invention.
Figure 2:
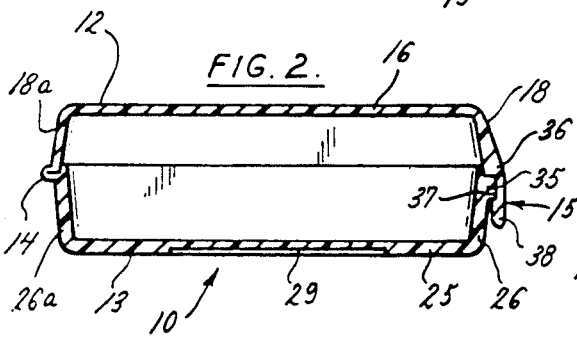
FIG. 2 is a sectional view taken along line 2—2 of FIG. 1.
Figure 3:
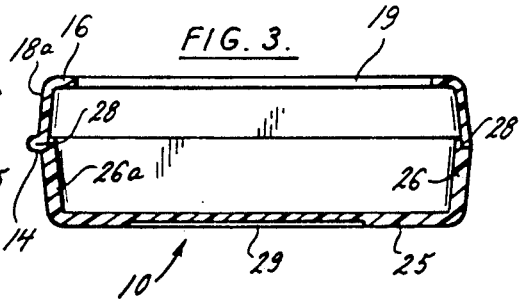
FIG. 3 is a sectional view taken along line 3—3 of FIG. 1.
Figure 4:
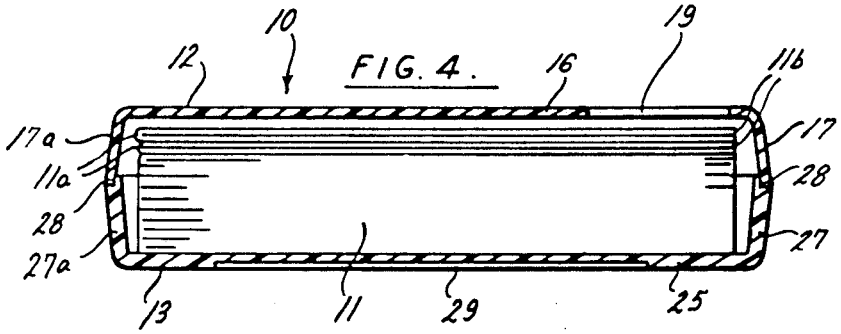
FIG. 4 is a longitudinal vertical sectional view showing the filled dispenser.

FIG. 1 shows a facial tissue dispenser 10 having a package of folded tissues 11 positioned therein. The dispenser 10 comprises a top half 12 and a bottom half 13. The top 12 and the bottom 13 are integrally formed in a molding operation of a suitable polymeric material and are provided at one longitudinal edge with an integral hinge 14. At the longitudinal edge opposed to the hinge 14 is a snap latch 15.

The top 12 includes a top wall 16, lateral end walls 17,17*a* and longitudinal side walls 18,18*a*. The top 16 is provided adjacent to one of the end walls 17 with a transverse slot 19 through which tissues are dispensed. The slot 19 extends a substantial part of the transverse distance between the side walls 18,18*a*. Behind the slot 19 is a free area 20 on which printed indicia 21 may be placed. This can include company logos, lettering, insignia, advertising, etc.

The bottom 13 comprises a bottom wall 25, longitudinal side walls 26,26*a* and lateral transverse end walls 27,27*a*. Each of the side walls 26,26*a* and the end walls 27,27*a* are provided on their free ends with a rabbet 28 extending outwardly from the interior of the dispenser 10. The corresponding side walls 18,18*a* and end walls 17,17*a* of the dispenser top 12 are designed to rest in the rabbet 28 when the dispenser 10 is closed. This provides a sturdy solid fit between the tope 12 and bottom 13 and rigidifies the dispenser 10 when in closed position. The bottom wall 25 is provided with a recess 29 in its outwardly extending face. The purpose of the recess is to accommodate further indicia, or as shown in FIGS. 5 and 6, means for attaching the dispenser to a fixed object.

The latch mechanism 15 comprises a longitudinal bead or lip 35 having a relatively square cornered face positioned on the outer edge of the bottom side wall 26 which is opposed to the hinge 14. On the side wall 18 of the cover top 12 which is opposite the hinge 14 is a clasp member 36 which includes an inwardly extending groove 37 designed to accommodate the lip 35 and a nose 38 which is positioned beneath the lip 35. Both the bottom end wall 26 and the top end wall 18 are slightly flexible so that the lip 35 can be snapped into the groove 37 to securely retain the dispenser 10 in closed condition.

Positioned within the dispenser 10 is a package of facial tissues 11 which are of the variety that are transversly folded 11*a* along their longitudinal length and are stacked in folded condition within the dispenser 10. The tissues 11 are positioned within the dispenser 10 such that the free or unfolded ends 11*b* are adjacent to the slot 19 whereby the top fold of each folded tissue 11 can be grasped and the tissue 11 can be extracted through the slot 19.

Figure 5:
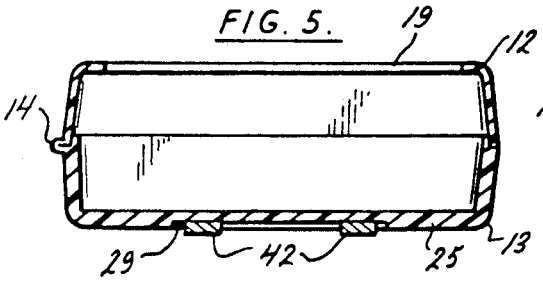
FIG. 5 is a view similar to FIG. 3 but showing a modification of the invention.
Figure 6:
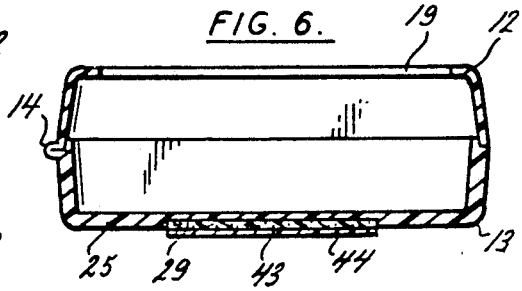
FIG. 6 is a view similar to FIG. 5 but showing another modification of the invention.

FIG. 5 shows a variation of the invention wherein a magnet or set of magnets 42 is positioned in the bottom wall recess 29 and secured to the bottom wall 25. The magnets 42 are used to releasibly secure the container to a metallic surface, such as a refrigerator door, the interior of an auto, etc.

FIG. 6 shows another variation of the invention wherein the bottom wall recess 29 has an adhesive covered tape 43 positioned therein. The tape 43 is secured to the bottom wall 25 and conventionally has a removable cover 44 which is peeled off when it is desired to attach the dispenser 10 to a fixed object.

This invention is intended to cover all changes and modifications of the example of the invention herein chosen for purposes of the disclosure which do not constitute departures from the spirit and scope of the invention.

What is claimed is:

1. A unitary one-piece polymeric tissue dispenser comprising:

(a) a hollow housing having a top member and bottom member; said top and bottom members having opposed longitudinal edges and opposed lateral edges which are juxtaposed when the housing is closed and latched, (b) hinge means along one set of longitudinal edges for attaching the top to the bottom at said edge, (c) latch means on the second set of longitudinal edges opposite the set of longitudinal edges defining said hinge means for securing the top housing member to the bottom housing member to retain a package of tissue within the housing, said latch means including a lip on the bottom member longitudinal edge and a flexible clasp on the opposed top member longitudinal side edge, said clasp protruding outwardly from the top member side edge and having an internal groove to accommodate and retain said lip when the top and bottom members are closed, (d) the top cover having an outer surface and being provided with a transverse opening in a portion of said outer surface adjacent to a lateral side edge, said opening communicating with the interior of the housing and permitting tissues to be removed therethrough, the remainder of the top cover outer surface being provided with printed indicia, (e) a depressed area in the outer surface of the bottom member, and (f) the bottom member longitudinal and lateral edges being provided with rabbets to engage to corresponding longitudinal and lateral edges of the top member.

2. The dispenser of claim 1 wherein the depressed area is provided with printed indicia.

3. The dispenser of claim 1 including magnet means positioned in the depressed area.

4. The dispenser of claim 1 including adhesive means positioned in the depressed area.

5. The combination of a unitary one-piece polymeric facial tissue dispenser and a pack of folded facial tissues comprising:

(a) a hollow housing having a top member and bottom member, said top and bottom members having opposed longitudinal edges and opposed lateral edges which are juxtaposed when the housing is closed and latched, (b) a pack of facial tissues positioned within the container and having transverse folds adjacent to one lateral edge and free ends adjacent to a second transverse edge, (c) hinge means along one set of longitudinal edges for attaching the top to the bottom at said edge, (d) latch means on the set of longitudinal edges opposite said hinge means for securing the top housing member to the bottom housing member for retaining said package of tissues within the housing, (e) the top cover having an outer surface and being provided with a transverse opening in a portion of the outer surface adjacent to a lateral side edge, said opening communicating with the interior of the housing and permitting tissues to be removed therethrough, the tissues being positioned in the dispenser with the free ends adjacent to said cover opening, the remainder of the top cover outer surface being provided with printed indicia, (f) a depressed area in the outer bottom surface, (g) said latch means including a lip on the bottom member longitudinal edge and a flexible clasp on the opposed top member longitudinal side edge, said clasp protruding outwardly from the top member side edge and having an internal groove to accommodate and retain said lip when the top and bottom members are closed.

6. The dispenser of claim 5 wherein the depressed area is provided with printed indicia.

7. The dispenser of claim 5 including magnet means positioned in the depressed area.

8. The dispenser of claim 5 including adhesive means positioned in the depressed area.

* * * * *